United States Patent [19]

Seeger et al.

[11] 4,359,036

[45] Nov. 16, 1982

[54] IGNITION SYSTEM FOR INTERNAL COMBUSTION ENGINES

[75] Inventors: Karl Seeger, Markgröningen; Werner Jundt, Ludwigsburg; Manfred Mezger, Markgröningen, all of Fed. Rep. of Germany

[73] Assignee: Robert Bosch GmbH, Stuttgart, Fed. Rep. of Germany

[21] Appl. No.: 213,591

[22] Filed: Dec. 5, 1980

[30] Foreign Application Priority Data

Mar. 14, 1980 [DE] Fed. Rep. of Germany ..... 3009822

[51] Int. Cl.[3] ..... F02P 3/00

[52] U.S. Cl. ..... 123/609; 123/414; 123/416; 123/652

[58] Field of Search ..... 123/609, 612, 613, 644, 123/650, 652, 414, 416

[56] References Cited

U.S. PATENT DOCUMENTS

| | | | |
|---|---|---|---|
| 4,248,195 | 2/1981 | Gorille | 123/609 |
| 4,253,443 | 3/1981 | Seeger et al. | 123/609 |
| 4,267,813 | 5/1981 | Hohne et al. | 123/609 |

FOREIGN PATENT DOCUMENTS

| | | | |
|---|---|---|---|
| 7998 | 2/1980 | European Pat. Off. | 123/416 |
| 2850113 | 9/1979 | Fed. Rep. of Germany . | |
| 2850115 | 9/1979 | Fed. Rep. of Germany . | |

*Primary Examiner*—P. S. Lall

*Attorney, Agent, or Firm*—Frishauf, Holtz, Goodman & Woodward

[57] ABSTRACT

An ingition system for internal combustion engines has dwell angle control apparatus for controlling the switching times of an electronic switch (21) in the primary circuit of an ignition coil (22) in dependence on the signals of a rotating sensor (10) or an ignition computer (11). Specifically, speed dependent counting values are periodically generated in a counting apparatus (13) each being counted down in a further counting apparatus (14) controlled by an edge of the sensed signal or a computed signal. Upon reaching a presettable triggering counting value, the electronic switch (21) is closed (start of dwell period). This triggering value is set by periodic up and down counting processes in a control counter (17) the upwards counting being constant with respect to time and the count-down process being determined by the length of time of current flow above a settable current value through the ignition coil (23). This allows the counting process of the speed dependent counting value to be triggered and the electronic switch to be opened (ignition time) by a single sensed signal edge per cycle.

6 Claims, 4 Drawing Figures

IGNITION SYSTEM FOR INTERNAL COMBUSTION ENGINES

STATE OF THE ART

The invention starts out from an ignition system for internal combustion engines with control apparatus for regulating the dwell angle of the type having an electronic switching in the ignition coil primary circuit responsive to signals derived from a rotating sensor or provided by an ignition computer.

Such ignition systems are known, for example, from DE-OS No. 2 746 885, DE-OS No. 2 850 113 or DE-OS No. 2 850 115. The dwell angle control of these known ignition systems is based on the principle of determining the count on a counter in dependence on the current through the primary winding of the ignition coil, the count in turn influencing the counting process for determining the start of the dwell period. However the known dwell angle control systems have the common disadvantage that they require a sensed signal, or an output signal from an ignition computer which has a definite on/off (keying) ratio. Both edges are required for determining the dwell angle. This has the disadvantage that, first of all, expensive sensors or ignition computers are required, since the accuracy of the two edges of such a signal relative to one another determines the accuracy of the computed dwell period. Further, in particular for multi-cylinder internal combustion engines, it is often difficult to achieve a corresponding matching of the on/off ratio of the control signal to the required on/off ratio of the apparatus for controlling the dwell angle. Here it is often necessary to re-dimension not only the sensor but also the evaluating circuit for different types of internal combustion engines.

THE INVENTION

According to the invention, the count-down of a speeddependent count value is started and the electronic switch is opened by one edge of the sensed signal and the triggering counting value is set by periodic up and down counting processes, the upward counting processes being constant in time and the downward counting processes being determined by the duration of flow of ignition coil current exceeding a presettable current value.

The ignition system according to the invention has the advantage that sensors without a predetermined fixed on/off ratio may be used for controlling the closure angle control apparatus. For example, the signal of a unipolar Wiegand sensor may be used for this purpose. Further, the eletronics may be used for all types of internal combustion engines.

A dynamically and particularly valuable regulation is achieved by superimposition of the output signal of the apparatus for controlling the dwell angle onto the output signal of the angle sensor or ignition computer controlling it in so far as these have a small on/off ratio which is suitable as a base dwell angle.

Furthermore, a circuit for interrupting the quiescent current and a control circuit for a minimum open time of the electronic switch in the primary current circuit of the ignition coil can be provided in a simple fashion.

DRAWING

Two embodiments of the invention are shown in the drawing and explained in greater detail in the following description.

FIG. 1 shows an example of a circuit of the first embodiment,

FIG. 2 the essential section of an example of a circuit of the second embodiment, FIG. 3 a signal diagram for explaining the first embodiment and FIG. 4 a representation of a characteristic curve of ignition timing for explaining the difference between the first and second embodiments.

DESCRIPTION OF THE EMBODIMENTS

Figure 1:
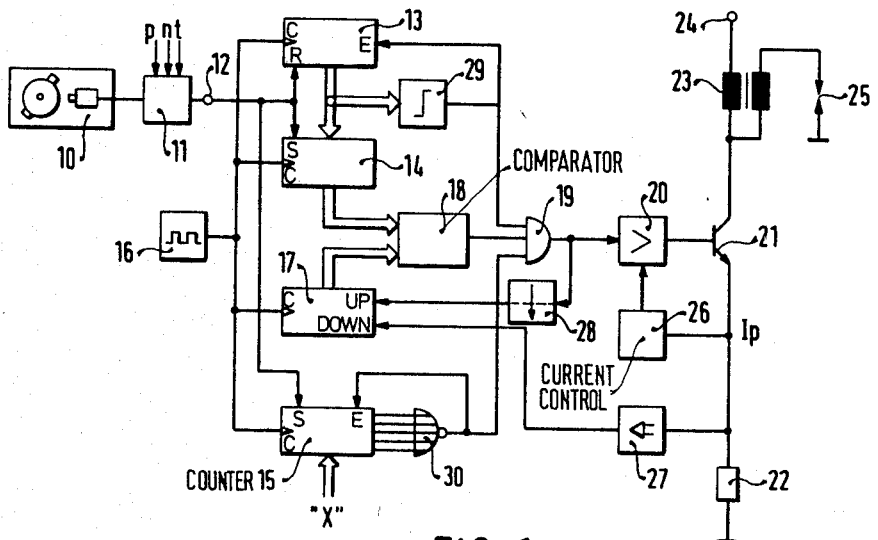

In the embodiment shown in FIG. 1, a sensor arrangement 10 preferably connected to the crankshaft of an internal combustion engine is connected to a well known ignition computer 11, which determines the ignition timing in dependence on parameters (for example pressure p, speed n, temperature T). The sensor arrangement 10 may for example be an inductive, an optical, a Hall - or a Wiegand-sensor. The required sensor needs to furnish only a single signal edge for each cycle. This is why the sensor arrangement can, for example, be a unipolar Wiegand sensor. The ignition computer 11 may for example be constructed in accordance with DE-OS No. 2 851 336.

The output of ignition computer 11 is connected through a terminal 12 to the reset input R of a speed computer 13 as well as to the set inputs S of an open time counter 14 and a limiting counter 15. An oscillator 16 used as a clock generator is connected with a clock input C of the three counters 13 through 15 as well as that of a fourth counter 17 connected as a control counter. The counting outputs of counters 14 and 17 are connected via a digital comparator 18 to the input of an AND gate 19 whose output is connected through an amplifier 20 to the control input of an electronic switch 21. The switching circuit of this electronic switch 21, a current measuring resistor 22, as well as the primary winding of ignition coil 23 form a series circuit connected between a supply voltage source 24 and ground potential. A starter gap 25 is connected into the secondary circuit of ignition coil 23, the starter gap generally being constituted by a spark plug in an internal combustion engine. If a plurality of spark plugs are present, a mechanical electronic high voltage distributor may be provided in known fashion. For limiting the current on the primary side, a current control apparatus 26 disclosed, for example in DE-OS No. 2 232 220, connected to current measuring resistor 22 and affects an amplifier 20. Furthermore, the voltage drop across current measuring resistor 22 is connected to the reverse counting input (down) of counter 17 through a threshold comparator 27. The forward counting input (up) of counter 17 is connected to the output of a timing member 28 which is triggered by the output of AND gate 19.

The counting outputs of speed counter 13 are connected to the counting input of the open time counter 14 as well as to a digital threshold stage 29, which is constructed either as a digital comparator or as an arrangement of gates. The output of threshold stage 29 is connected with a further input of AND gate 19 as well as to the blocking input (E, Enable) of counter 13. The counting inputs of limiting counter 15 are preferably set to a fixed counting value X by hard wiring. The counting outputs of this counter 15 are connected to a NOR gate 30 acting as a O detector as well as to a further input of AND gate 19 and the blocking input (E) of counter 15.

Figure 2:
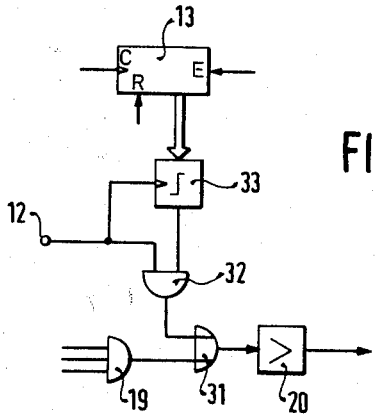

In the second embodiment illustrated in FIG. 2, those components which correspond to the component in FIG. 1 have the same reference symbol. FIG. 2 is simply an expansion relative FIG. 1. For the rest components are the same as those of FIG. 1. An OR gate 31 is connected between AND gate 19 and amplifier 20, the second input of OR gate 31 being connected to the output of an AND gate 32. The first input of this AND gate 32 is connected to terminal 12 and the second input via a threshold stage 33 to the counting outputs of speed counter 13.

Figure 3:
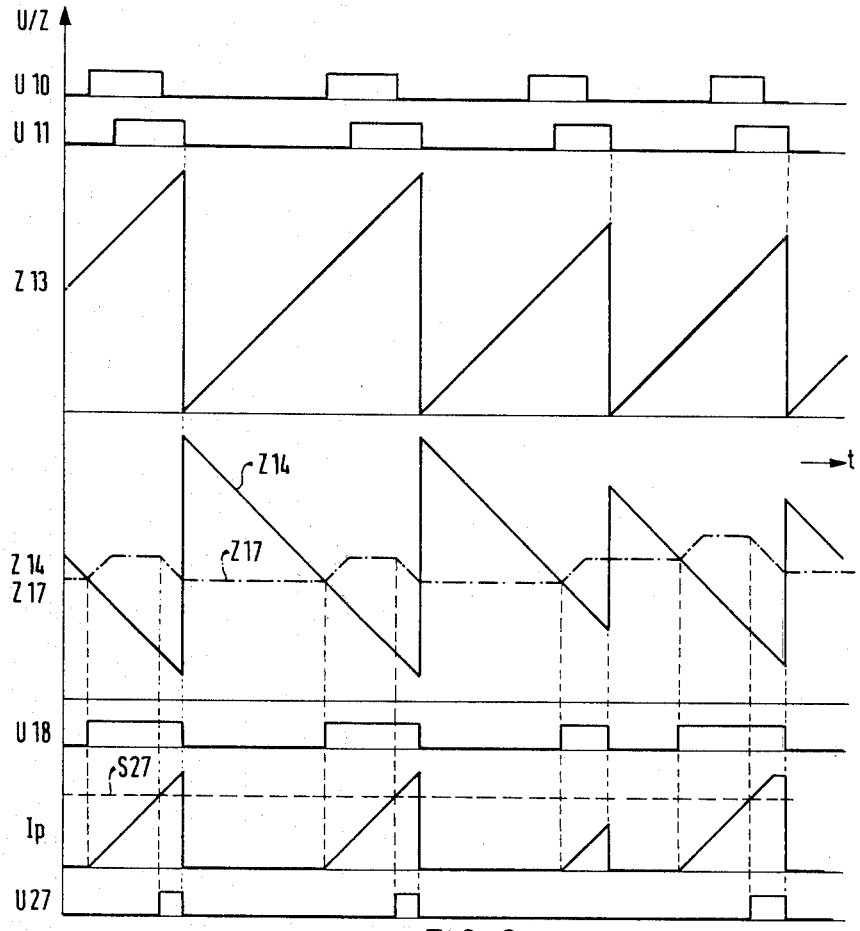

The operation of the embodiment shown in FIG. 1 will be explained in the following text with reference to the signal diagram illustrated in FIG. 3. Sensor 10 generates a sensor signal U10, on the basis of which an ignition signal U11 shifted relative thereto is determined in ignition computer 11. The signals U10, U11 show a determined on/off ratio in the illustration, this on/off ratio however not being required for the embodiment according to FIG. 1, since only the trailing edge of signal U11 which determines the ignition time is required for determining the start of the closure time. For this reason any desired ignition time sensor (sensor apparatus 10 and/or ignition computer 11) with any arbitary on/off ratio or even impulses may be used.

The trailing edge of signal U11 causes counter 13 to be reset. The counter renews counting of the pulses of oscillator 16 in the forward direction until it is again reset with the next trailing edge. At the time of the trailing edge of an ignition signal U11 there is thus present an actual speed dependent counting value in counter 13 which is taken over by counter 14 shortly before resetting. It is then counted down with the same counting pulses. Of course care must be taken by the use of delay members which are not shown, that the takeover into counter 14 takes place before resetting of counter 13. If the speed remains constant, the final count in counter 14 prior to a new setting must again be the same count as in the previous period, namely "O". The count on counter 14 is compared to the count on counter 17 in comparator 18 and an output signal is generated when the count Z17 is larger than the count Z14. This comparator output signal causes, first, electronic switch 21 to be closed via AND gate 19 and amplifier 20, thereby causing primary current Ip to flow and further, the timing member 28 is triggered causing a forward count in counter 17 during its latched time. After the latched time, the count Z17 remains constant, until the threshold value S27 of threshold comparator 27 is reached by the voltage drop across resistor 22. Starting at this moment, signal U27 causes counter 17 to be switched to "count down", until the current Ip again goes to zero at the ignition time. If the speed remains constant (the first two illustrated cycles) then control counter 17 reaches its original value after each up/down counting process. The latched time of timing member 28 corresponds to approximately 20 to 30 percent of the charging time of ignition coil 23. In the illustrated case the counting process in counter 17 takes place at the same counting frequency. If a stronger or weaker regulation is to be achieved, of course another counting frequency may be chosen. In the third illustrated cycle the achieved current value Ip is too small because of acceleration. Since the threshold value S27 is not reached, no count down process takes place in counter 17, which causes the switch-in threshold for digital comparator 18 to be shifted to higher values, i.e. this value will be reached earlier in the cycle by the open time counter, which causes the dwell time to be increased. In this way the dwell period is corrected by control counter 17. This correction of course takes place not only for an acceleration but also for example for a decrease in battery voltage which also causes a lesser primary curent Ip to flow, or for a deceleration. In the fourth illustrated cycle a very small acceleration again takes place, but a control process in the direction of a smaller closure time takes place, since, because of the start of current limiting, the curent limiting apparatus 26 signals an excessively great dwell angle which in turn is corrected by a control counter 17.

Figure 4:
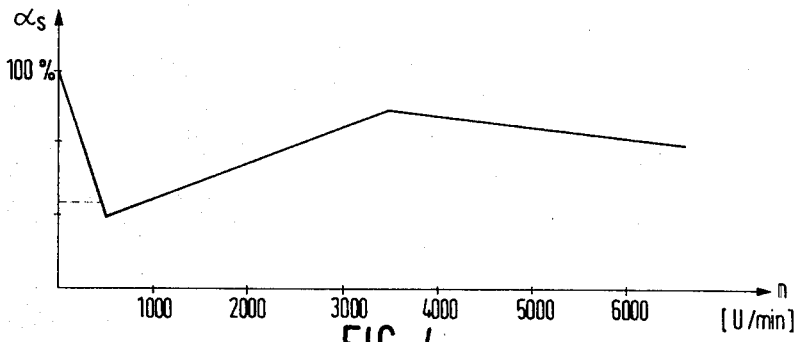

Speed counter 13 can additionally be used in a simple fashion for quiescent current cut-off, that is for de-energizing the ignition apparatus when the speed has decreased below a value possible during normal operation. This very low speed corresponds to a very high counting value in counter 13, which is contained in threshold stage 29 as a threshold value. If this threshold is reached, then the output of threshold stage 29 causes counter 13 to be blocked for further counting via blocking input E and at the same time AND gate 19 is blocked, so that no ignition signals from the output of comparator 18 can reach electronic switch 21. Since for dynamic reasons it is not desirable to control the dwell angle up to the smallest speeds, open time counter 14 may logically have a smaller number of bits than speed counter 13. The characteristic curve of dwell angle illustrated in FIG. 4 as a solid line thus may be explained as follows: for very small engine speeds up to approximately 500 r.p.m., the counting value of speed counter 13 is larger than the maximum possible counting value in counter 14. Counter 14 therefore takes over the same value, namely the maximum possible counting value for it, in each cycle. The open time is therefore constant in this range, which, for increasing speed, leads to a decrease of the dwell angle. In the region between 500 U/min and 3500 U/min, a pure regulation without any influence from threshold stage 29 and counter 15 takes place. Starting at 3500 revolutions, counter 15 starts to exert an influence, in that a minimum dwell time at high speeds is assured by this counter 15. This results from the fact that counter 15 is set to the fixed counting value X by each trailing edge of the ignition timing generators 10, 11 and then starts the count downnwards. Starting at 3500 U/min, this counting process is not ended when the start of the closure time is signaled the output signal of comparator 18. However AND gate 19 remains blocked until an output signal is generated by NOR gate 30 which causes the counting in counter 15 to terminate.

Of course the speed limits for the described three ranges can be arbitrarily varied or matched to different types of internal combustion engines by variation of the capacity of the counter, the counting frequency 14 and by changes of the fixed counting value X.

In the example shown in FIG. 2 the output signal of the ignition timing sensor 10 or 11 is superimposed on the output signal of AND gate 19 via terminal 12. This of course is only possible when this output signal has a suitable on/off ratio of approximately 20 to 35%. The threshold value of threshold stage 33 determines below which speed (in the illustrated example the speed of 480 U/min) the superimposition is to initiated. For this purpose threshold stage 33 is to have a bistable operation, that is for each trailing edge of a signal U12 at terminal 12 a 1-signal is generated at the output when the threshold value (corresponding to a value less than the set-in speed value) is passed on the basis of which signal U12 can pass through AND gate 32. This 1-signal remains until the value again falls below the threshold value at the following trailing edge of a signal U11. This function can also be carried out by a T flipflop connected to the output of a simple threshold stage. The effect is such that starting at the time of the superimposition a constant dwell angle is set by signal U11. This is represented by the dashed line.

We claim:

1. Ignition system for an internal combustion engine including an ignition coil, in the primary circuit of which an electronic switch and in the secondary circuit of which at least one spark gap is connected, apparatus for controlling the dwell angle for control of the switching times of said electronic switch in dependence on the signals of an ignition timing sensor, said sensor providing only a single signal per ignition event, and a counting apparatus in which speed dependent counting values are determined periodically and are counted down, each value under control of one edge of a signal from said sensor, the electronic switch being closed upon reaching of a settable triggering counting value, said system further comprising:

means for simultaneously initiating the count-down of said speed dependent counting value and the opening of the electronic switch (21) in response to said one edge of a signal from said sensor, and means for setting said triggering counting value by periodic up and down counting processes, the upwards count in processes being constant in time and the downwards counting processes being determined by the length of time of current flow of current in excess of a presettable current value through the ignition coil (23).

2. Ignition system according to claim 1, in which a comparator (18) is interposed in the connection from the outputs of said counting apparatus (17) for determining the triggering counting value as well as the counting outputs of the counting apparatus (14) for count-down of the speed dependent counting values to the electronic switch (21).

3. Ignition system according to claim 1, in which said counting apparatus includes means (13) for determination of the speed dependent counting value and, in which for quiescent cut off, the outputs of said last-mentioned means are connected to a threshold stage (29), by means of which the control signal for said electronic switch (21) may be blocked by a gate (19).

4. Ignition system according to claim 3, in which, for preservation of a minimum open time of said electronic switch (21) at high speeds said counting apparatus includes a counter (15) connected as a timing member for always counting down a fixed number (X) starting at the ignition time and blocking the control signal for the electronic switch (21) via said gate (19) during the count-down.

5. Ignition system comprising an ignition time generator for determining a basic dwell angle in accordance with any one of claims 1-4, wherein means are provided for additively applying the output signal of said ignition timing generator (10,11) upon the control signal for the electronic switch (21).

6. Ignition system according to claim 5, wherein a gate (32) is provided and also a threshold stage (33) to which said speed dependent counting value is applied and by means of which the output signal of the ignition timing generator (10,11) is blocked by said gate (32) upon crossing of a lower speed threshold, so that no further additive application of said output signal upon said electronic switch control signal takes place.

* * * * *